US005186468A

United States Patent [19]

Davies

[11] Patent Number: 5,186,468

[45] Date of Patent: Feb. 16, 1993

[54] FIREARMS TARGET

[76] Inventor: Clifford L. Davies, 54 West Acres, Steamboat Springs, Colo. 80477

[21] Appl. No.: 805,865

[22] Filed: Dec. 10, 1991

[51] Int. Cl.[5] ..... F41J 1/00; F41J 5/24

[52] U.S. Cl. ..... 273/378

[58] Field of Search ..... 273/378, 380, 407, 408, 273/410

[56] References Cited

U.S. PATENT DOCUMENTS

| | | | |
|---|---|---|---|
| 3,330,561 | 7/1967 | Kandel | 273/378 |
| 3,353,827 | 11/1967 | Dun, Jr. | 273/378 |
| 3,370,852 | 2/1968 | Kandel | 273/378 |
| 3,423,092 | 1/1969 | Kandel | 273/378 |
| 3,486,752 | 12/1969 | Colvin et al. | 273/378 |
| 3,895,803 | 7/1975 | Loe | 273/378 |
| 3,899,175 | 8/1975 | Loe | 273/378 |

*Primary Examiner*—William H. Grieb
*Attorney, Agent, or Firm*—Dorr, Carson, Sloan & Peterson

[57] ABSTRACT

A firearms target is made of a target sheet bearing a predetermined target pattern backed with a layer of woven fabric of a contrasting color. The target sheet is a material, such as paper, which permits a projectile to pierce the target sheet leaving an opening of substantially the same size as the projectile. In contrast, the projectile pierces the fabric leaving a multitude of severed fabric strands which extend into the area of the fabric pierced by said projectile. When viewed from in front of the target, these severed strands are highly visible through the hole created by the projectile in the target sheet due to the contrasting colors.

18 Claims, 1 Drawing Sheet

FIREARMS TARGET

BACKGROUND OF THE INVENTION

1. Field of the Invention

The present invention relates generally to the field of firearms targets. More specifically, the present invention discloses a target that provides a highly visible indication of the location of a hit.

2. statement of the Problem

Conventional firearms targets made of paper are easily produced in large numbers at nominal cost. However, it is often difficult to determine the location of hits on these targets without the assistance of binoculars or a spotting telescope. This is particularly true if the target is printed in black and white, since any bullet holes in the target will also typically appear to be black.

A number of devices and processes have been invented in the past relating to high visibility or "indicating" targets, including the following:

| Inventor | Patent No. | Issue Date |
|---|---|---|
| Kandel | 3,423,092 | Jan. 21, 1969 |
| Loe | 3,899,175 | Aug. 12, 1975 |
| Loe | 3,895,803 | July 22, 1975 |
| Dun, Jr. | 3,353,827 | Nov. 21, 1967 |

Kandel discloses a firearms target having a layer of foamed rubber or foamed plastic behind the target sheet. The foamed rubber has highly contrasting color, such as red or orange. When the target is punctured by a bullet, the resulting hole in the target sheet remains open and well defined, while the hole through the foamed rubber is self-closing, to some degree, so that the colored foam rubber is visible through the hole in the target sheet.

The Loe '175 patent discloses a target having a metal foil sheet mounted in a spaced relation in front of a backup sheet of a highly contrasting color. When struck by a bullet, a hole substantially larger than the bullet is produced in the foil sheet. The bullet makes only a conventional size hole in the backup sheet. The point of impact thus appears on the target as a relatively large area of color which can easily be seen at targe range distances.

The Loe '803 patent discloses a target having a brightly colored backing sheet with a transparent plastic film bonded on its front surface. A conventional target pattern is printed in a black and white ink layer on the front surface of the transparent film so as to completely cover the backing sheet. When the target is struck by a bullet, a section substantially larger than the bullet is removed from the ink layer at the point of impact. A smaller hole is made in the film layer and the backing sheet, thus causing the point of impact to appear highly enlarged and in a brightly contrasting color.

Dun discloses a firearms target in which a resilient backing member of a contrasting color is mounted behind the bulls-eye of the target. The backing member is made of natural rubber, silicone rubber, polyvinylchloride or polyethylene (col. 3, line 35–39, and claim 1).

3. Solution to the Problem

None of the prior art references uncovered in the search show a firearms target having the structure of the present invention, namely, a target sheet with a backing sheet made of a woven fabric having a contrasting color. This design can be easily produced using widely available materials with minimal assembly, thereby providing a very low cost product. In addition, the size of the holes in the present target accurately reflect the size and location of the bullet impact, which allows accurate measurement of several bullet holes in close vicinity to one another, unlike several of the prior art targets which enlarge the area of impact. Finally, the present target offers sturdy construction making it highly suitable for rugged use in the field.

SUMMARY OF THE INVENTION

This invention provides a firearms target having a target sheet bearing a predetermined target pattern backed with a layer of woven fabric of a contrasting color. The target sheet is made of a a material, such as paper, which permits a projectile to pierce the target sheet leaving an opening of substantially the same size as the projectile. In contrast, the projectile pierces the fabric leaving a multitude of severed fabric strands which extend into the area of the fabric pierced by said projectile. When viewed from in front of the target, these severed strands are highly visible through the hole created by the projectile in the target sheet due to the contrasting colors.

A primary object of the present invention is to provide a high visibility target that can be mass produced at low cost.

Another object of the present invention is to provide a high visibility target that can be readily mounted and used in place of a conventional paper target at existing shooting ranges.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
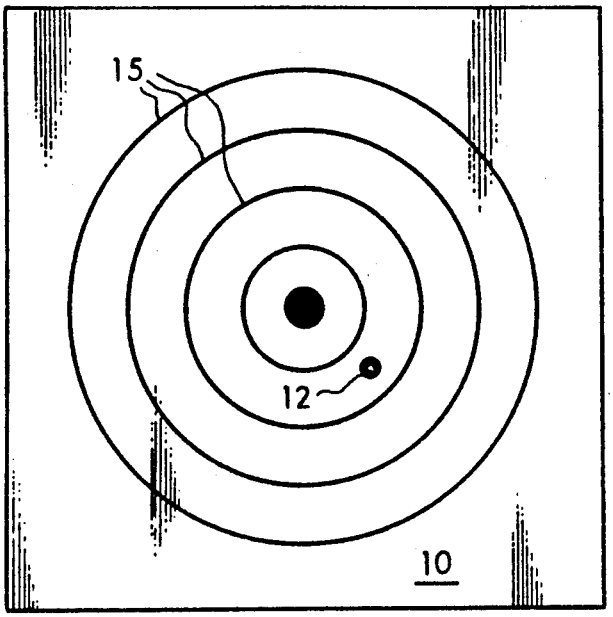
FIG. 1 is a front view of the target with a representative bullet hole.

Turning to FIG. 1., a front view of the target sheet 10 is shown. The target sheet 10 is typically made of paper printed by conventional means with a target pattern 15 (e.g. a bulls eye or grid pattern) on its front surface. The selection of materials that can be used as the target sheet 10 is limited only in that a bullet should be able to readily pierce the target sheet leaving a cleanly cut, well defined hole 12 roughly the size the projectile.

Figure 3:
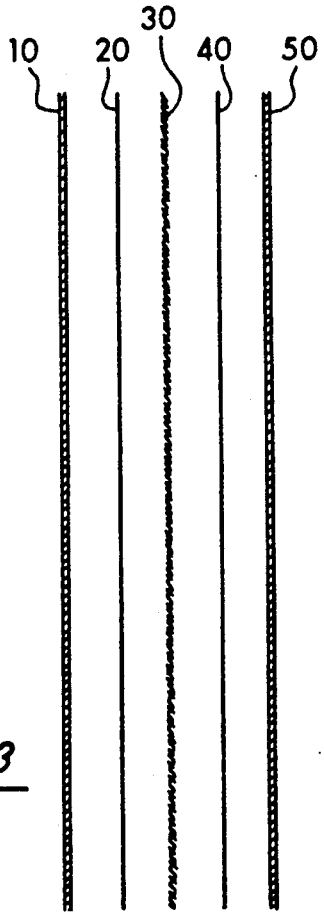
FIG. 3 is an exploded cross-sectional view showing the various layers used in making the target.

An exploded cross-sectional view of the layers of the target is provided in FIG. 3. A backing sheet 30 made of a woven material is attached to the rear surface of the target sheet 10. The backing sheet 30 is made of a woven material having a contrasting color to the colors of the target sheet 10. For example, the target sheet 10 typically has a black target pattern 15 printed on a white background. A backing sheet 30 with a bright orange or red color provides suitable contrast against the black and white colors of the target sheet 10. In the preferred embodiment, the backing sheet 30 is made of a rip-stop nylon fabric, woven fiberglass, or Cordura TM fabric marketed by DuPont. In particular, Cordura TM fabric with a thread size of approximately 1000 denier has been found to be suitable. However, it should be understood that any of a wide variety of fabrics, thread sizes, and contrasting colors can be employed.

Figure 4:
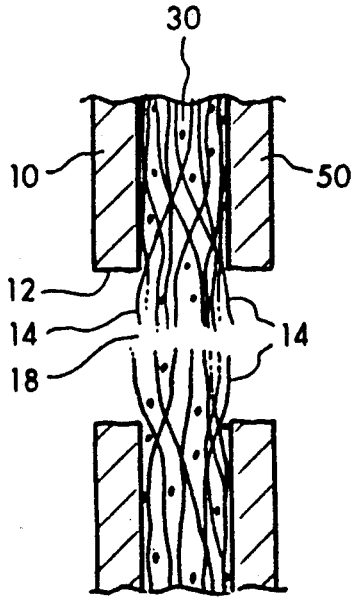
FIG. 4 is a cross-sectional view showing the layers in the target after being pierce by a bullet.
Figure 2:
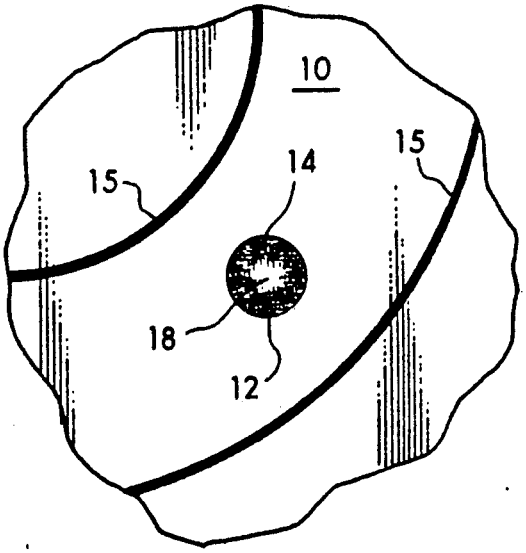
FIG. 2 is an enlarged fragmentary front view of the bullet hole and the surrounding area of the target.

The bullet hole 12 is shown in greater detail in the fragmentary front view of FIG. 2. A cross-sectional view of the portion of the target in the vicinity of the bullet hole 12 is shown in FIG. 4. As previously discussed, a bullet striking the target sheet 10 will pierce the target sheet 10 leaving an opening 12 through the target sheet 10 that is roughly the same size as the bullet. The projectile continues forward and pierces the backing sheet 30, thereby severing and/or fraying many of the strands of the woven fabric in the path of the projectile. The severed ends of these strands are pushed out of the way as the bullet passes through the backing sheet 30. In addition, at least some of the unsevered fabric strands will elastically deform as the bullet passes through the backing sheet 30. After the bullet has passed, the frayed ends 14 of the severed fabric strands will tend to return to their previous positions, thereby partially filling the hole 18 in the backing sheet 30 created by the bullet as shown in FIGS. 2 and 4. It is important to note that these severed fabric strands extend inward beyond the edge of the hole 12 in the target sheet 10 and therefore can be readily seen through the hole 12 in the target sheet 10 by a shooter viewing the front of the target. Visibility of these fabric strands is further enhanced by the color contrast between the backing sheet (e.g. red or orange) and the target sheet (e.g. black and white).

As shown in FIG. 3, a thin sheet of thermally activated dry-mount glue 20 (of the type used to mount pictures for framing) can be employed to attach the backing sheet to the target sheet. A second target sheet 50 can also be attached to the rear of the backing sheet 30 by means of a second sheet of dry-mount glue 40 as shown in FIG. 3. The second target sheet 50 is printed with a different targeting pattern than appears on the front target sheet to offer the shooter a choice of target patterns simply by reversing the device.

The preceding discussion describes targets that are manufactured and completely assembled at a central factory. However, it should be expressly understood that the present invention can be practiced by other means. For example, a kit for producing the target can be made by providing a backing sheet (i.e., a layer of woven material) with a layer adhesive on one side. The exposed adhesive is temporarily covered with a removeable cover sheet at the factory and the product is distributed in this form. In the field, a shooter can peal off the cover sheet to expose the adhesive. The backing sheet can thereby be attached by the adhesive to the rear surface of virtually any conventional paper target selected by the shooter.

The above disclosure sets forth a number of embodiments of the present invention. Other arrangements or embodiments, not precisely set forth, could be practiced under the teachings of the present invention and as set forth in the following claims.

I claim:

1. A firearms target comprising:

a target sheet having a front target surface of at least one color and a rear surface, said target sheet permitting a projectile striking said target sheet to pierce said target sheet leaving an opening through said target sheet of substantially the same size as said projectile; and a backing sheet attached to said rear surface of said target sheet having a contrasting color to said target sheet color, said backing sheet being made of a dry woven fabric permitting said projectile to pierce said backing sheet leaving a multitude of severed fabric strands extending into the area of said backing sheet pierced by said projectile, whereby said contrasting color of said severed fabric strands is visible through said opening in said target sheet to provide a visible indication of the path of said projectile.

2. The firearms target of claim 1 wherein said severed fabric strands substantially fill said pierced area of said backing sheet.

3. The firearms target of claim 1 wherein said target surface further comprises a target pattern in a contrasting color to said backing sheet color and said target sheet colors.

4. The firearms target of claim 3 further comprising a second target sheet having a front surface attached to the rear of said backing sheet, and a rear surface printed with a second target pattern.

5. The firearms target of claim 1 wherein said backing sheet is comprised of nylon fabric.

6. The firearms target of claim 1 wherein said backing sheet is comprised of woven fiberglass.

7. The firearms target of claim 1 wherein said target sheet is comprised of paper.

8. The firearms target of claim 1 further comprising a layer of adhesive between said target sheet and said backing sheet adapted to secure said target sheet to said backing sheet.

9. The firearms target of claim 8 wherein said layer of adhesive comprises dry-mount glue.

10. A firearms target comprising:

a target sheet having a rear surface and a front target surface of at least one color and further bearing a target pattern, said target sheet permitting a projectile striking said target sheet to pierce said target sheet leaving an opening through said target sheet of substantially the same size as said projectile; and a dry layer of woven fabric attached to said rear surface of said target sheet having a contrasting color to said target sheet color and to said target pattern, said fabric permitting said projectile to pierce said fabric leaving a multitude of severed fabric strands extending into the area pierced by said projectile, whereby said contrasting color of said severed fabric strands is visible through said opening in said target sheet to provide a visible indication of the path of said projectile.

11. The firearms target of claim 10 wherein said severed fabric strands substantially fill said pierced area.

12. The firearms target of claim 10 further comprising a second target sheet having a front surface attached to the rear of said fabric, and a rear surface bearing a second target pattern.

13. The firearms target of claim 10 wherein said fabric sheet is comprised of rip-stop nylon.

14. The firearms target of claim 10 wherein said fabric sheet is comprised of woven fiberglass.

15. The firearms target of claim 10 wherein said target sheet is comprised of paper.

16. The firearms target of claim 10 further comprising a layer of adhesive between said target sheet and said fabric adapted to secure said target sheet to said fabric.

17. The firearms target of claim 16 wherein said layer of adhesive comprises dry-mount glue.

18. A firearms target comprising:

a sheet of paper having a rear surface and a front target surface with at least one predetermined color and bearing a predetermined target pattern; and a layer of dry nylon fabric attached to said rear surface of said target sheet having a contrasting color to said paper colors and to said target pattern.

* * * * *